United States Patent [19]

Missalla

[11] Patent Number: 4,620,676

[45] Date of Patent: Nov. 4, 1986

[54] DISMOUNTABLE REEL

[76] Inventor: Manfred Missalla, 130 Don Park Rd., #6, Markham, Ontario, Canada, L3R 1C3

[21] Appl. No.: 777,754

[22] Filed: Sep. 19, 1985

[51] Int. Cl.[4] ..... B65H 75/18; B65H 75/22

[52] U.S. Cl. ..... 242/77; 242/77.2; 242/115

[58] Field of Search ..... 242/115, 116, 117, 77.2, 242/77.3, 77, 118.5–118.8, 77.4

[56] References Cited

U.S. PATENT DOCUMENTS

| | | | |
|---|---|---|---|
| 1,777,666 | 10/1930 | Gilbert | 242/77.3 |
| 1,850,265 | 3/1932 | German | 242/77.2 |
| 1,946,764 | 2/1934 | Schaub | 242/77.2 |
| 3,704,838 | 12/1972 | Bernier et al. | 242/115 X |

FOREIGN PATENT DOCUMENTS

| | | | |
|---|---|---|---|
| 347348 | 4/1931 | United Kingdom | 242/77.3 |

*Primary Examiner*—John M. Jillions
*Attorney, Agent, or Firm*—George A. Rolston

[57] ABSTRACT

A dismountable reel having two circular side members with inside and outside faces, attachment rings on the inside faces of the side members, with openings around the rings, a core member formed of a strip of sheet metal, junctions at the ends of the strip, so that same may be formed into a generally cylindrical shape, and, attachment tongues on the edges of the strip, which are interengageable with the rings.

3 Claims, 3 Drawing Figures

FIG.1.
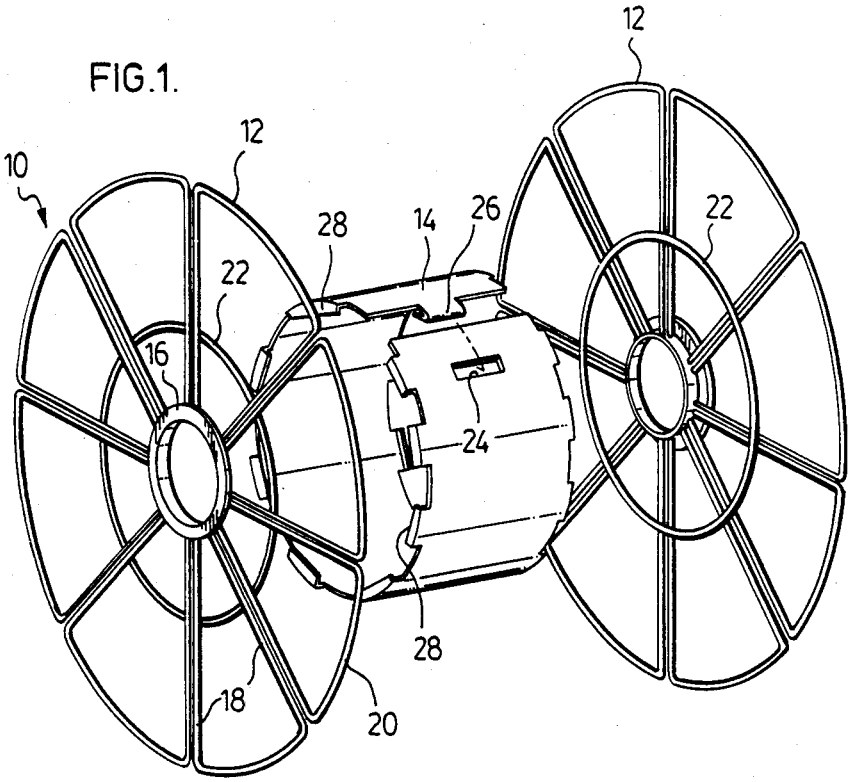
FIG. 2.
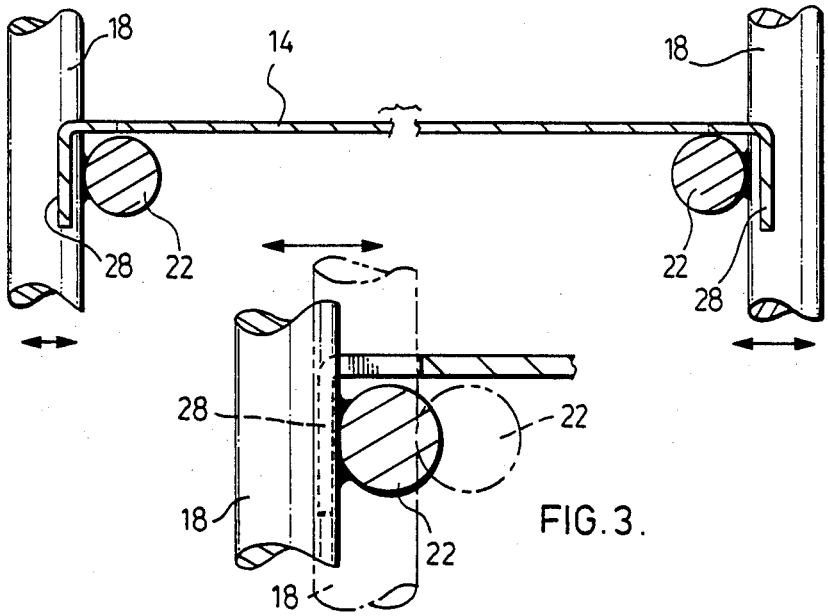
FIG. 3.

DISMOUNTABLE REEL

The invention relates to a dismountable reel, and is of particular interest for use in association with wire products.

BACKGROUND OF THE INVENTION

Dismountable reels offer substantial savings as compared with pre-assembled reels. They are easier to ship and store, and may be set up as required in the manufacturer's plant.

After usage by the customer, of the product on the reel, the reels may again be dismounted and returned to the manufacturer.

This offers substantial savings over conventional reels which are costly to ship and store, and cause problems with customers who may be forced to store reels as they are emptied, until a sufficient quantity has been assembled for shipment back to the manufacturer.

Numerous proposals in the past have been made for dismountable reels, but most of them have suffered from various disadvantages. They were either excessively complicated to assemble, or did not achieve significant savings in shipping and storage space, or were costly to manufacture.

When reeling certain products such as wire products, and in particular welding wire, other problems arise.

Some form of reels used for welding wire are arranged with a wire cage at the core. As the wire is wound on the cage, it is bent and kinked.

This interferes with the convenient and effective use of the wire by the customer and is considered undesirable.

In addition to this, when reeling wire products the conventional spooling equipment provides a level wind control. As the reel is filled up, substantial pressure is applied to the side flanges of the reel. Unless they are made extremely strong, they tend to bow outwardly or "dish".

The distortion of the reel in this way by the wire again causes inconvenience to the customer.

Clearly, it is desirable to provide a reel in which the two sides or flanges of the reel remain flat after the wire has been wound on.

BRIEF SUMMARY OF THE INVENTION

With a view to overcoming these various disadvantages the invention comprises a dismountable reel having two identical side wall members of generally circular shape, and having inside and outside faces, and attachment ring means on the inside faces of said wall members, openings in said wall members around said attachment ring means, and a core member formed of a generally rectangular strip of sheet metal, junction interlocking means at both ends of said strip, whereby the same may be formed into a generally cylindrical shape, and attachment tongues on both edges of said strip, said tongues being inter-engageable with said rings.

More particularly, it is an objective of the invention to provide such a dismountable reel wherein said tongues and rings define a predetermined spacing therebetween in the assembled reel, whereby to provide a pre-set degree of movement.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

FIG. 1 is a perspective exploded illustration of a dismountable reel according to the invention;

FIG. 2 is an enlarged section along the line 2—2 of FIG. 1, and,

FIG. 3 is an enlarged section of a detail of FIG. 2.

DESCRIPTION OF A SPECIFIC EMBODIMENT

Referring now to FIGS. 1 and 2, the invention will be seen to be illustrated in the form of a dismountable reel indicated generally as 10. The reel in this particular embodiment is designed for winding welding wire. The reels during spooling at the manufacturer's plant are located between two rotatable support discs which clamp on the exterior of the reel on opposite sides. The support discs are then rotated, spooling the wire on the reel.

Such equipment is well known, and in any event forms no part of the present invention.

The reel 10 will be seen to comprise two identical side wall members 12, and a core member 14.

Each of the side members 12 comprises, in this embodiment, a hub 16, and a plurality of spokes 18. An outer rim 20 is attached to the free ends of the spokes 18.

In the particular embodiment shown, the spokes 18 and outer rim 20 are formed integrally in a generally triangular-shaped formation as shown, for simplicity of construction.

It will, however, be appreciated that the invention is not limited to this form of construction but would include any construction of the side wall member.

On the inwardly directed faces of both side wall members 18, an attachment ring 22 is provided, concentric with hub 16.

Openings are defined between the spokes 18, around the ring 22, for purposes to be described below.

It will, of course, be appreciated that the side wall member 12 could equally well be stamped out of sheet metal, or formed of other material. In the present invention it is shown formed of wire rod material merely for the sake of convenience and providing adequate strength for the use intended.

The core member 14 is formed of a generally rectangular strip of sheet metal, which is adapted to be bent round to form a generally cylindrical shape.

The ends of the strip 14 may be fastened together by means of the slot 24 and flange 26.

The core member 14 is provided on either side edge with a plurality of attachment tongues 28, which are located apart from one another and define gaps or notches between them.

When assembled the tongues 28 are fitted around the attachment ring 22, with the notches between the tongues matching the location of the spokes 18. The inward limit of the gaps or notches is defined by the side edges of the strip 14, and is arranged to abut against the spokes 18.

Thus, the tongues 28 fit around the attachment ring 22 between any two spokes 18.

The tongues 28 are of generally L-shaped construction, and define a predetermined spacing away from the edge of the strip 14 defined by the notches.

In this way, when the tongues 28 are located in position around the ring 22, the side members 12 are free to move to a certain limited extent outwardly and inwardly relative to the edges of the core 14.

In use, the spool is first of all assembled in the manufacturer's plant, and is then placed, empty, between the two clamping discs of the spooling machine.

The effect of this will be to close up the two side wall members 12 towards one another.

The wire is then spooled on the core 14 in the usual way. The fact that the core 14 is formed of sheet metal in cylindrical shape will avoid kinking of the wire.

Once spooling is completed, the reel is then removed from the spooling machine. Since there is no longer clamping pressure, clamping the two side wall members 12 together, they will be free to spring apart slightly. This will thus relieve the pressure built up by the spooling of the wire on the side walls. Dishing of the side walls due to the pressure of the wire on the reel will thus be eliminated.

After the reel is emptied, it can be disassembled for shipping back to the manufacturer.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A dismountable reel comprising;

two side wall members of generally circular shape, having inside and outside faces;

attachment bar means of predetermined width on the inside faces of the said wall members;

openings around said attachment bar means;

a core member formed of a generally rectangular strip of sheet metal;

junction means at both ends of said strip, whereby the same may be formed into a generally cylindrical shape, and, attachment tongue members extending outwardly from either side edge of said core member;

notches between said tongue members;

bent portions on the free ends of said tongue members, adapted to wrap around said attachment bar means, and, abutment edges on said notches adapted to abut against said inner faces of said side wall members, said bent portions of said tongue members being spaced from said abutment edges of said notches a predetermined distance whereby to permit relative movement between said side wall members, and said core member.

2. A dismountable reel as claimed in claim 1 wherein said attachment bar means comprises a generally annular ring located on the inside face of said side wall members.

3. A dismountable reel as claimed in claim 2 wherein said side wall members are formed of wire rod material, defining spokes extending radially from a generally central hub portion, said ring being attached to the inside faces of said spokes, and said notches between said tongue members being adapted to register with said spokes, with said tongue members and said bent portions overlapping and wrapping partially around said ring between said spokes.

* * * * *